United States Patent [19]

Klein et al.

[11] 4,415,647

[45] Nov. 15, 1983

[54] POLYMERIC VEHICLE FOR DYE IMAGE-RECEIVING LAYER CONTAINING A POLY(VINYLIMIDAZOLE) MORDANT

[75] Inventors: Gerald W. Klein, Pittsford; Wayne A. Bowman, Walworth, both of N.Y.

[73] Assignee: Eastman Kodak Company, Rochester, N.Y.

[21] Appl. No.: 427,067

[22] Filed: Sep. 29, 1982

[51] Int. Cl.[3] ..... G03C 1/40; G03C 1/10; G03C 5/54

[52] U.S. Cl. ..... 430/213; 430/238; 430/941; 428/500; 428/522

[58] Field of Search ..... 430/213, 941, 518, 238; 428/522, 500; 101/464

[56] References Cited

U.S. PATENT DOCUMENTS

| | | | |
|---|---|---|---|
| 3,721,558 | 3/1973 | Abbott | 430/213 |
| 3,847,615 | 11/1974 | Yoshida et al. | 430/213 |
| 4,124,386 | 11/1974 | Yoshida et al. | 430/213 |
| 4,273,853 | 6/1981 | Ponticello et al. | 430/213 |
| 4,282,305 | 8/1981 | Brust et al. | 430/213 |
| 4,358,524 | 11/1982 | Sutton et al. | 430/213 |

FOREIGN PATENT DOCUMENTS 1561238 2/1980 United Kingdom .

*Primary Examiner*—Richard L. Schilling
*Attorney, Agent, or Firm*—Harold E. Cole

[57] ABSTRACT

Photographic elements, diffusion transfer assemblages and processes are described wherein a dye image-receiving layer comprising a poly(vinylimidazole) mordant is employed in a nonmordanting, water-permeable polymeric vehicle. The polymeric vehicle comprises recurring units derived from a hydroxyalkyl acrylate ester, and/or an N-hydroxyalkylacrylamide, and/or an N-alkylacrylamide. Image sharpness is thereby improved, especially under conditions of high temperature and humidity.

42 Claims, No Drawings

POLYMERIC VEHICLE FOR DYE IMAGE-RECEIVING LAYER CONTAINING A POLY(VINYLIMIDAZOLE) MORDANT

This invention relates to photography, and more particularly to color diffusion transfer photography employing dye image-providing materials. Dye images are obtained in a dye image-receiving layer comprising a poly(vinylimidazole) mordant in a nonmordanting, water-permeable polymeric vehicle. The vehicle comprises recurring units derived from a hydroxyalkyl acrylate ester, and/or an N-hydroxyalkylacrylamide, and/or an N-alkylacrylamide. Image sharpness is thereby improved, especially under conditions of high temperature and humidity.

A recognized limitation of image transfer systems is the loss of image sharpness or definition due to uncontrolled dye migration. Relatively sharp images, formed by direct unidirectional diffusion of released dye to a mordant, can lose significant sharpness with time due to lateral migration of the dye within the mordant layer. One approach to this problem has been to use a "stronger" mordant. This, however, can create additional problems. As the mordant-dye binding forces increase, severe problems may be encountered with dark and/or light dye stability. Thus, selecting a mordant primarily on the basis of dye stability generally leads to a choice of a weaker-binding mordant which increases the tendency for post-process dye migration and image "smear". Generally, dye image sharpness losses become more severe as the temperature and humidity are raised.

Poly(vinylimidazole) mordants are desirable in diffusion transfer systems because they provide good dye stability. However, these mordants allow substantial lateral dye migration at high humidity. This limitation is severe enough to prevent the practical use of these mordants where peel-apart image transfer receivers encounter high humidity storage.

While polymeric vehicles to be employed with poly(vinylimidazole) mordants are known in the art, many such materials have a tacky surface and do not adhere properly to the receiver support on which they are coated.

It would be desirable to provide a polymeric vehicle which can be used with a poly(vinylimidazole) mordant to reduce the lateral migration of an image dye contained within such mordant layer, such polymeric vehicle also exhibiting good physical properties and the necessary adhesion to a support on which the vehicle and mordant are coated.

U.S. Pat. Nos. 4,273,853 of Ponticello et al and 4,282,305 of Brust et al relate to the use of poly(vinylimidazole) mordants in dye image-receiving elements for diffusion transfer systems. It is disclosed therein that these mordants may be coated with various hydrophilic binders including gelatin and poly(acrylamide). As will be shown by comparative tests hereinafter, the particular polymeric vehicle employed in our invention provides better image sharpness than gelatin and better adhesion to a receiver support than poly(acrylamide).

In U.K. Pat. No. 1,561,238, a group of hydrophilic, film-forming polymers is disclosed as a binder for a mordant. Included among the list of such materials is hydroxyethylacrylamide. There is no disclosure in this patent, however, that such material should be used with a poly(vinylimidazole) mordant, as in the present invention.

U.S. Pat. No. 3,721,558 of Abbott relates to the use of various hydrophobic mordant vehicles in image transfer receiving elements. This patent, however, does not disclose the use of the particular mordant or vehicle as described herein.

In U.S. Pat. No. 3,847,615, there is a diclosure of the use of various hydroxyalkyl acrylates in an image-receiving element. These materials are disclosed for use, however, as a spacer layer and not as a vehicle for the mordant layer, as described herein.

U.S. application Ser. No. 310,720 of Sutton et al, filed Oct. 13, 1981, now U.S. Pat. No. 4,358,524, issued Nov. 9, 1982, relates to the use of various cross-linked polymers in a dye image-receiving layer or layer adjacent thereto, which has a source of metal ions associated therewith, in order to prevent the biuret stain encountered when gelatin is used as a vehicle. Included among the recurring units for this polymeric material is a 2-hydroxyethyl acrylate. There is no recognition in that application, however, of the problem involved in obtaining image sharpness with poly(vinylimidazole) mordants or that a 2-hydroxyethyl acrylate polymer as described herein would provide improved image sharpness with such mordants.

A photographic element in accordance with our invention comprises a support having thereon at least one photosensitive silver halide emulsion layer having associated therewith a dye image-providing material, the support also having thereon a dye image-receiving layer comprising a poly(vinylimidazole) mordant in a nonmordanting, water-permeable polymeric vehicle which comprises recurring units derived from a hydroxyalkyl acrylate ester, and/or an N-hydroxyalkylacrylamide, and/or an N-alkylacrylamide.

In a preferred embodiment of our invention, the vehicle has the following formula:

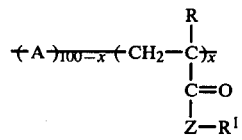

wherein:

A represents recurring units of one or more addition polymerizable monomers;

R represents H or methyl;

Z represents O or NH;

$R^1$ represents alkyl or hydroxyalkyl of 1 to about 6 carbon atoms when Z is NH, and represents hydroxyalkyl of 1 to about 6 carbon atoms when Z is O; and each x is a weight percentage integer of from about 10 to 100.

Addition polymerizable monomers useful as A in the formula above include the following: acrylic esters, such as methyl methacrylate, butyl acrylate, butyl methacrylate and ethyl acrylate; vinyl esters, such as vinyl acetate; amides, such as acrylamide, diacetone acrylamide, N-methylacrylamide and methacrylamide; nitriles, such as acrylonitrile and vinylphenylacetonitrile; ketones, such as methyl vinyl ketone, ethyl vinyl ketone and p-vinylacetophenone; halides, such as vinyl chloride, vinylidene chloride and vinylbenzyl chloride; ethers, such as methyl vinyl ether, ethyl vinyl ether and vinylbenzyl methyl ether; $\alpha,\beta$-unsaturated acids, such as acrylic acid and methacrylic acid and other unsaturated acids such as vinylbenzoic acid; simple heterocyclic monomers, such as vinylpyridine and vinylpyrrolidone; olefins, such as ethylene, propylene, butylene and styrene as well as substituted styrene; diolefins, such as butadiene and 2,3-dimethylbutadiene, and other vinyl monomers within the knowledge and skill of an ordinary worker in the art.

Especially good results are obtained when A in the above formula is acrylamide, styrene or an alkyl acrylate, the alkyl group of which has from 1 to about 6 carbon atoms.

In another embodiment of our invention R in the above formula represents methyl, Z represents O and $R^1$ represents hydroxyethyl. In another embodiment of our invention, R represents H, Z represents NH and $R^1$ represents isopropyl or hydroxymethyl. In another embodiment of our invention, R represents H, Z represents O and $R^1$ represents hydroxypropyl or hydroxyethyl.

The vehicle can be present with the poly(-vinylimidazole) mordant in the dye image-receiving layer in any amount which is effective for the intended purpose. In general, good results are obtained when the vehicle is present at a concentration of from about 25 to about 75 percent by weight of the dye image-receiving layer.

Hydroxyalkyl acrylate esters useful in our invention include the following:
2-hydroxyethyl acrylate,
2-hydroxyethyl methacrylate and
2-hydroxypropyl acrylate.

N-hydroxyalkylacrylamides useful in our invention include the following:
N-methylolacrylamide,
N-(2-hydroxypropyl)methacrylamide,
N-(2-hydroxyethyl)acrylamide,
N-(2-hydroxyethyl)methacrylamide and
α-acrylamido-2-hydroxymethyl-1,3-propanediol.

N-alkylacrylamides useful in our invention include the following:
N-methylacrylamide,
N-methylmethacrylamide,
N,N-dimethylacrylamide,
N,N-dimethylmethacrylamide,
N-ethylacrylamide,
N-ethylmethacrylamide,
N,N-diethylacrylamide,
N,N-diethylmethacrylamide,
N-propylacrylamide,
N-propylmethacrylamide,
N-isopropylacrylamide,
N-isopropylmethacrylamide,
N-butylacrylamide,
N-tertbutylacrylamide,
N-tertbutylmethacrylamide,
N-isobutylacrylamide and
N-isobutylmethacrylamide, Specific polymeric vehicles which have been found to be especially useful in our invention include the following:
poly(2-hydroxyethyl methacrylate),
poly(acrylamide-co-N-methylolacrylamide),
poly(N-isopropylacrylamide-co-2-hydroxyethyl acrylate),
poly(N-isopropylacrylamide-co-2-hydroxypropyl acrylate),
poly(2-hydroxypropyl acrylate),
poly(2-hydroxyethyl methacrylate-co-2-hydroxypropyl acrylate) and
poly(N-isopropylacrylamide-co-2-hydroxyethyl methacrylate).

The polymeric vehicles employed in our invention are well known polymeric materials per se, and can be prepared by solution polymerization techniques which are well known to those skilled in the art.

Any poly(vinylimidazole) mordant can be used in our invention as long as it has some recurring units of a vinylimidazole monomer, which may or may not be substituted. Such mordants include those disclosed in U.S. Pat. No. 4,273,853, the disclosure of which is hereby incorporated by reference. They include, for example, the following:

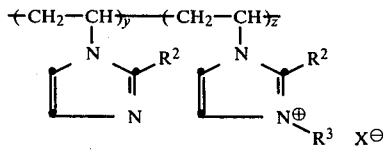

wherein $R^2$ is H or alkyl, preferably containing from 1 to about 12 carbon atoms such as methyl, propyl, isobutyl or hexyl; $R^3$ is alkyl, preferably containing from 1 to about 12 carbon atoms such as methyl, ethyl, isobutyl, hexyl, decyl, hydroxymethyl, hydroxyethyl, or carboxyalkyl; or aralkyl containing from about 7 to about 10 carbon atoms such as benzyl, phenethyl, or p-chlorobenzyl; $X^{\theta}$ is an acid anion such as chloride, bromide, methanesulfonate, p-toluenesulfonate, methosulfate, nitrate, acetate or sulfate;

y is 10 to 100 weight percent; and z is 0 to 90 weight percent.

In a preferred embodiment of our invention, the mordant comprises the following recurring units:

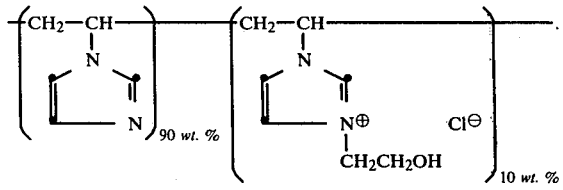

The glass transition temperature, Tg, of mordants as described above decrease sharply with an increase in humidity. Thus, such mordants show substantial image "smear" at room temperature and 65 percent RH or higher. It is theorized that the polymeric vehicles of our invention may provide the correct hydrophilic/hydrophobic balance so that when they are coated with the mordant, the Tg is increased at high humidities, resulting in less lateral dye diffusion.

The photosensitive element described above can be treated in any manner with an alkaline processing composition to effect or initiate development. A preferred method for applying processing composition is by use of a rupturable container or pod which contains the composition. In general, the processing composition employed in this invention contains the developing agent for development, although the composition could also just be an alkaline solution where the developer is incorporated in the photographic element, image-receiving element or process sheet, in which case the alkaline solution serves to activate the incorporated developer.

A photographic assemblage in accordance with this invention is adapted to be processed by an alkaline processing composition, and comprises:

(1) a photographic element as described above; and (2) a dye image-receiving layer.

In this embodiment, the processing composition may be inserted into the assemblage, such as by interjecting processing solution with communicating members similar to hypodermic syringes which are attached either to a camera or camera cartridge. The processing composition can also be applied by means of a swab or by dipping in a bath, if so desired. Another method of applying processing composition to a film assemblage which can be used in our invention is the liquid spreading means described in U.S. application Ser. No. 143,230 of Columbus, filed Apr. 24, 1980.

In a preferred embodiment of the invention, the assemblage itself contains the alkaline processing composition and means containing same for discharge within the film unit. There can be employed, for example, a rupturable container which is adapted to be positioned during processing of the film unit so that a compressive force applied to the container by pressure-applying members, such as would be found in a camera designed for in-camera processing, will effect a discharge of the container's contents within the film unit.

The dye image-providing material useful in this invention is either positive- or negative-working, and is either initially mobile or immobile in the photographic element during processing with an alkaline composition. Examples of initially mobile, positive-working dye image-providing materials useful in this invention are described in U.S. Pat. Nos. 2,983,606; 3,536,739; 3,705,184; 3,482,972; 2,756,142; 3,880,658 and 3,854,985. Examples of negative-working dye image-providing materials useful in this invention include conventional couplers which react with oxidized aromatic primary amino color developing agents to produce or release a dye such as those described, for example, in U.S. Pat. No. 3,227,550 and Canadian Pat. No. 602,607. In a preferred embodiment of this invention, the dye image-providing material is a ballasted, redox-dye-releasing (RDR) compound. Such compounds are well known to those skilled in the art and are, generally speaking, compounds which will react with oxidized or unoxidized developing agent or electron transfer agent to release a dye. Such nondiffusible RDR's include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; 4,149,892 of Deguchi et al; 4,198,235 and 4,179,291 of Vetter et al; *Research Disclosure* 15157, November, 1976 and *Research Disclosure* 15654, April, 1977. Such nondiffusible RDR's also include positive-working compounds, as described in U.S. Pat. Nos. 3,980,479; 4,139,379; 4,139,389; 4,199,354, 4,232,107, 4,199,355 and German Pat. No. 2,854,946, the disclosures of which are hereby incorporated by reference.

In a preferred embodiment of this invention, positive-working quinone RDR's are employed and the photographic element contains an incorporated reducing agent as described in U.S. Pat. No. 4,139,379, referred to above. In this embodiment, the positive-working quinone RDR compound as incorporated in a photographic element is incapable of releasing a diffusible dye. However, during photographic processing under alkaline conditions, the compound is capable of accepting at least one electron (i.e., being reduced) and thereafter releases a diffusible dye. Further details are found in U.S. Pat. No. 4,139,379, the disclosure of which is hereby incorporated by reference.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819.

When the means for discharging the processing composition is a rupturable container, it is usually positioned in relation to the photographic element and the image-receiving element described above so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

In another embodiment, the dye image-receiving layer in the above-described film assemblage is integral with the photographic element and is located between the support and the lowermost photosensitive silver halide emulsion layer. One useful format for integral negative-receiver photographic elements is disclosed in Belgian Pat. No. 757,960. In such an embodiment, the support for the photographic element is transparent and is coated with a dye image-receiving layer as described above, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is useful is disclosed in Canadian Pat. No. 928,559. In this embodiment, the support for the photographic element is transparent and is coated with the dye image-receiving layer described above, a substantially opaque, light-reflective layer and the photosensitive layer or layers described above. A rupturable container, containing an alkaline processing composition and an opacifier, is positioned between the top layer and a transparent cover sheet which has thereon, in sequence, a neutralizing layer, and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, a neutralizing layer and timing layer are located underneath the photosensitive layer or layers. In that embodiment, the photographic element would comprise a support having thereon, in sequence, a neutralizing layer, a timing layer and at least one photosensitive silver halide emulsion layer having associated therewith a dye image-providing material. A dye image-receiving layer as described above would be provided on a second support with the processing composition being applied therebetween. This format could either be integral or peel-apart as described above.

Another embodiment of the invention uses the image-reversing technique disclosed in British Pat. No. 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

A process for producing a photographic transfer image in color according to our invention from an imagewise-exposed photosensitive element comprising a support having thereon at least one photosensitive silver halide emulsion layer having associated therewith a dye image-providing material, comprises treating the element with an alkaline processing composition in the presence of a silver halide developing agent to effect development of each of the exposed silver halide emulsion layers. An imagewise distribution of dye image-providing material is formed as a function of development and at least a portion of it diffuses to a dye image-receiving layer to provide the transfer image.

The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 g/m$^2$ has been found to be useful. The dye image-providing material is usually dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; or phenylenediamine compounds such as N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-di-methyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

In our invention, dye image-providing materials can be used which produce diffusible dye images as a function of development. Either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using negative-working ballasted, redox dye-releasers. After exposure of the film assemblage or unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-initiated reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a neutralizing layer in the film unit or image-receiving unit lowers the pH of the film unit or image receiver to stabilize the image.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive layer halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after inbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. patent application Ser. No. 184,714, filed Sept. 8, 1980.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering mterials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference. *Research Disclosure* and *Product Licensing Index* are publications of Industrial Opportunities Ltd.; Homewell, Havant; Hampshire, P09 1EF, United Kingdom.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

A multicolor, photosensitive donor element of the peel-apart type was prepared by coating the following layers in the order recited on an opaque poly(ethylene terephthalate) film support. Coverages are parenthetically given in g/m$^2$ unless otherwise stated.

(1) Polymeric acid layer of poly(n-butyl acrylate-co-acrylic acid) at a 30:70 weight ratio equivalent to 140 meq. acid/m$^2$;

(2) Timing layer of a 1:1 physical mixture of poly(acrylonitrile-co-vinylidene chloride-co-acrylic acid) (weight ratio 14:79:7) and the carboxy-ester-lactone formed by cyclization of a vinyl acetate-maleic anhydride copolymer in the presence of 1-butanol to produce a partial butyl ester (ratio of acid:ester of 15:85) (4.8);

(3) Cyan RDR (0.32), 2-(2-octadecyl)-5-sulfohydroquinone (0.047) and gelatin (1.6);

(4) Red-sensitive, negative silver chloride emulsion (0.32 Ag) and gelatin (0.65);

(5) Interlayer of 2,5-didodecylhydroquinone (0.65) and gelatin (0.65);

(6) Magenta RDR (0.43), 2-(2-octadecyl)-5-sulfohydroquinone (0.029) and gelatin (0.97);

(7) Green-sensitive, negative silver chloride emulsion (0.41 Ag), octadecylquinone (0.020) and gelatin (0.65%);

(8) Interlayer of 2,5-didodecylhydroquinone (0.65) and gelatin (0.81);

(9) Yellow RDR (0.54), 2-(2-octadecyl)-5-sulfohydroquinone (0.028), bis(vinylsulfonyl)methyl ether (0.055) and gelatin (0.97);

(10) Blue-sensitive, negative silver chloride emulsion layer (0.32 Ag) and gelatin (0.65); and

(11) Overcoat layer of 2,5-didodecylhydroquinone (0.32) and gelatin (0.88).

Cyan RDR

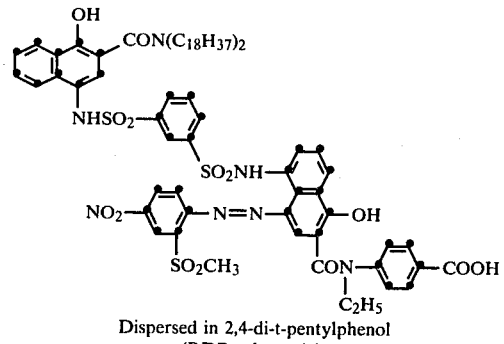

Dispersed in 2,4-di-t-pentylphenol
(RDR:solvent 1:2)

Magenta RDR

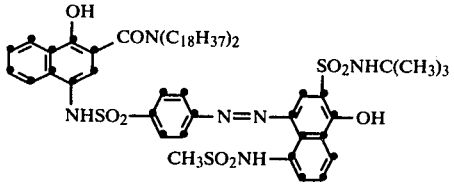

Dispersed in N,N—diethyllauramide
(RDR:solvent 1:2)

Yellow RDR

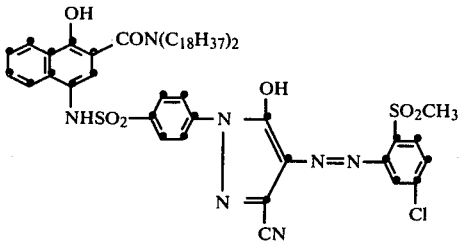

Dispersed in di-n-butyl phthalate
(RDR:solvent 1:2)

A. A control receiving element was prepared by coating ETA 4-hydroxymethyl-4-methyl-1-phenyl-3-pyrazolidinone (0.22 g/m$^2$), hardener 1,4-butanediol diglycidyl ether (0.22 g/m$^2$) and mordant poly[1-vinylimidazole-co-3-(2-hydroxyethyl)-1-vinylimidazolium chloride] (90:10 mole ratio) (3.8 g/m$^2$) on a polyethylene-coated paper support.

B. A control receiving element similar to A was prepared except that gelatin was added as a vehicle at a coverage of 1.1 g/m$^2$.

C. A control receiving element was prepared similar to A except that a polymeric vehicle poly(acrylamide) was added at a coverage of 3.8 g/m$^2$.

D. A receiving element was prepared similar to A except that a polymeric vehicle poly(acrylamide-co-N-methylacrylamide) (90:10 weight ratio) was added at a coverage of 2.6 g/m$^2$.

E. A receiving element was prepared similar to A except that the mordant coverage was 2.6 g/m$^2$ and a polymeric vehicle poly(2-hydroxyethyl methacrylate) was added at a coverage of 3.8 g/m$^2$.

An activator solution was prepared as follows:

Potassium hydroxide: 0.6 N
5-Methylbenzotriazole: 3.0 g/l
11-Aminoundecanoic acid: 2.0 g/l
Potassium bromide: 2.0 g/l A sample of the donor element was exposed in a sensitometer to a parallel-line resolution test chart. The exposure was adjusted to provide a Status A density range between $D_{min}$ and approximately 1.8 neutral $D_{max}$.

The exposed donor element was soaked in the activator solution described above in a shallow-tray processor for 15 seconds at 28° C. (82.5° F.) and then laminated between nip rollers to a sample of the receiving elements described above. After five minutes, the donor and receiver were peeled apart.

The highest resolution of the test chart for which discrete lines were distinguishable (as lines/mm) was determined by visual observation. The resolution of a "fresh" transfer was determined within 2–3 hours after delamination. The resolution after a "high humidity" test was also obtained. The "high humidity" test consisted of suspending the image surface over a beaker of hot tap water (≃35° C.) loosely covered with aluminum foil for a period of about 18 hours. This test roughly compares to a 3-day 32° C./90% RH test. Greater sharpness is indicated by higher resolution. The following results were obtained:

TABLE 1

| Receiver | Polymeric Vehicle | Resolution (lines/mm) Fresh | Resolution (lines/mm) High Humidity |
|---|---|---|---|
| A (Control) | None | 10 | 3.2 |
| B (Control) | Gelatin | 10 | 4.5 |
| C (Control) | Poly(acrylamide) | * | * |
| D | Poly(acrylamide-co-N—methylolacrylamide) (90:10) | 10 | 7.1 |
| E | Poly(2-hydroxyethyl-methacrylate) | 11 | 8.0 |

*Receiver had a very tacky surface. After lamination, it was very difficult to peel the donor element from the receiver element. Portions of the receiver stuck to the donor and vice versa. Thus, no resolution data could be obtained.

The above results indicate that the use of a polymeric vehicle in accordance with our invention provides a greater image sharpness when the mordant is subjected to high humidity conditions. Use of the polymeric vehicle of our invention also provides a coating which has physical properties which are superior to closely related polymeric materials.

EXAMPLE 2

Receiving elements similar to those of Example 1 were prepared except that the mordant coverage and the polymeric vehicle employed are as listed in Table 2 below.

The same evaluation procedure was used as in Example 1, except that the resolution of the test exposure was determined after incubation of the receiving element for 3 days at 32° C./90% RH. The following results were obtained:

TABLE 2

| Receiver Composition: Mordant Coverage (g/m$^2$) | Receiver Composition: Polymeric Vehicle (g/m$^2$) | Resolution (lines/mm) After 3 days at 32° C./90% RH |
|---|---|---|
| 5.4 (Control) | None | 2.8 |
| 3.2 | Poly(N—isopropylacrylamide-co-2-hydroxyethyl acrylate) (30:70 wt. ratio) (2.2) | 3.6 |
| 2.2 | Poly(N—isopropylacrylamide-co-2-hydroxyethyl acrylate) (34:66 wt. ratio) (3.2) | 4.0 |
| 3.2 | Poly(N—isopropylacrylamide-co-2-hydroxyethyl acrylate) (50:50 wt. ratio) (2.2) | 3.2 |
| 2.2 | Poly(N—isopropylacrylamide-co-2-hydroxyethyl acrylate) (70:30 wt. ratio) (3.2) | 4.5 |
| 3.2 | Poly(N—isopropylacrylamide-co-2-hydroxypropyl acrylate) (70:30 wt. ratio) (2.2) | 3.6 |

The above results again indicate that use of a polymeric vehicle in accordance with our invention provides a greater image sharpness when the mordant is subjected to high temperature and humidity conditions.

EXAMPLE 3

Receiving elements similar to those of Example 1 were prepared except that the mordant coverage and the polymeric vehicle employed are as listed in Table 3 below.

The same evaluation procedure was used as in Example 2. The following results were obtained:

TABLE 3

| Receiver Composition: Mordant Coverage (g/m$^2$) | Receiver Composition: Polymeric Vehicle (g/m$^2$) | Resolution (lines/mm) After 3 days at 32° C./90% RH |
|---|---|---|
| 2.6 (Control) | None | 2.8 |
| 2.6 | Poly(2-hydroxyethyl methacrylate) (2.6) | 5.0 |
| 2.6 | Poly(2-hydroxypropyl acrylate) (2.6) | 4.0 |
| 2.6 | Poly(2-hydroxyethyl methacrylate-co-2-hydroxypropyl acrylate) (50:50 wt. ratio) (5.4) | 3.6 |
| 2.6 | Poly(N—isopropylacrylamide-co-2-hydroxyethyl methacrylate) (10:90 wt. ratio) (5.4) | 4.5 |

Again, the above results indicated that the use of a polymeric vehicle in accordance with our invention provides a greater image sharpness when the mordant is subjected to high temperature and humidity conditions.

The invention has been described in detail with particular reference to preferred embodiments thereof, but it will be understood that variations and modifications can be effected within the spirit and scope of the invention.

What is claimed is:

1. In a photographic element comprising a support having thereon at least one photosensitive silver halide emulsion layer having associated therewith a dye image-providing material, said support also having thereon a dye image-receiving layer comprising a poly(vinylimidazole) mordant in a nonmordanting, water-permeable polymeric vehicle, the improvement wherein said vehicle comprises recurring units derived from a hydroxyalkyl acrylate ester, and/or an N-hydroxyalkylacrylamide, and/or an N-alkylacrylamide.

2. The photographic element of claim 1 wherein said vehicle comprises recurring units having the following formula:

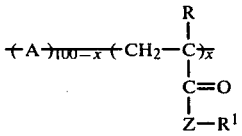

wherein:

A represents recurring units of one or more addition polymerizable monomers;

R represents H or methyl;

Z represents O or NH;

$R^1$ represents alkyl or hydroxyalkyl of 1 to about 6 carbon atoms when Z is NH, and represents hydroxyalkyl of 1 to about 6 carbon atoms when Z is O; and each x is a weight percentage integer of from about 10 to 100.

3. The photographic element of claim 2 wherein said addition polymerizable monomer is acrylamide, styrene or an alkyl acrylate, the alkyl group of which has from 1 to about 6 carbon atoms.

4. The photographic element of claim 2 wherein R represents methyl, Z represents O and $R^1$ represents hydroxyethyl.

5. The photographic element of claim 2 wherein R represents H, Z represents NH and $R^1$ represents isopropyl or hydroxymethyl.

6. The photographic element of claim 2 wherein R represents H, Z represents O and $R^1$ represents hydroxypropyl or hydroxyethyl.

7. The photographic element of claim 1 wherein said vehicle is present at a concentration of from about 25 to about 75 percent by weight of said dye image-receiving layer.

8. The photographic element of claim 1 wherein said mordant comprises the following recurring units:

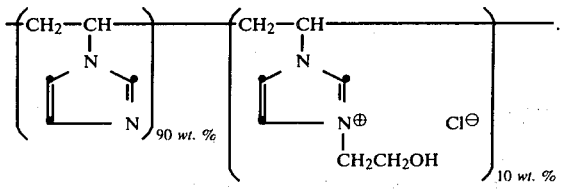

9. The photographic element of claim 1 wherein said vehicle comprises poly(2-hydroxyethyl methacrylate), poly(acrylamide-co-N-methylolacrylamide), poly(N-isopropylacrylamide-co-2-hydroxyethyl acrylate), poly(N-isopropylacrylamide-co-2-hydroxypropyl acrylate), poly(2-hydroxypropyl acrylate), poly(2-hydroxyethyl methacrylate-co-2-hydroxypropyl acrylate) or poly(N-isopropylacrylamide-co-2-hydroxyethyl methacrylate.

10. The photographic element of claim 1 which comprises said support having thereon a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

11. In a photographic assemblage comprising:

(a) a support having thereon at least one photosensitive silver halide emulsion layer having associated therewith a dye image-providing material; and (b) a dye image-receiving layer comprising a poly(vinylimidazole) mordant in a nonmordanting, water-permeable polymeric vehicle, the improvement wherein said vehicle comprises recurring units derived from a hydroxyalkyl acrylate ester, and/or an N-hydroxyalkylacrylamide, and/or an N-alkylacrylamide.

12. The assemblage of claim 11 wherein said vehicle comprises recurring units having the following formula:

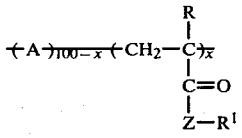

wherein:

A represents recurring units of one or more addition polymerizable monomers;

R represents H or methyl;

Z represents O or NH;

$R^1$ represents alkyl or hydroxyalkyl of 1 to about 6 carbon atoms when Z is NH, and represents hydroxyalkyl of 1 to about 6 carbon atoms when Z is O; and each x is a weight percentage integer of from about 10 to 100.

13. In a photographic assemblage comprising (a) a photosensitive element comprising a support having thereon at least one photosensitive silver halide emulsion layer having associated therewith a dye image-providing material;

(b) a dye image-receiving layer comprising a poly(vinylimidazole) mordant in a nonmordanting, water-permeable polymeric vehicle; and (c) an alkaline processing composition and means containing same for discharge within said assemblage;

the improvement wherein said vehicle comprises recurring units derived from a hydroxyalkyl acrylate ester, and/or an N-hydroxyalkylacrylamide, and/or an N-alkylacrylamide.

14. The assemblage of claim 13 wherein said vehicle comprises recurring units having the following formula:

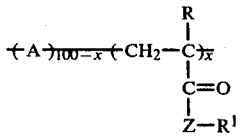

wherein:

A represents recurring units of one or more addition polymerizable monomers;

R represents H or methyl;

Z represents O or NH;

$R^1$ represents alkyl or hydroxyalkyl of 1 to about 6 carbon atoms when Z is NH, and represents hydroxyalkyl of 1 to about 6 carbon atoms when Z is O; and each x is a weight percentage integer of from about 10 to 100.

15. The assemblage of claim 14 wherein said addition polymerizable monomer is acrylamide, styrene or an alkyl acrylate, the alkyl group of which has from 1 to about 6 carbon atoms.

16. The assemblage of claim 14 wherein R represents methyl, Z represents O and $R^1$ represents hydroxyethyl.

17. The assemblage of claim 14 wherein R represents H, Z represents NH and $R^1$ represents isopropyl or hydroxymethyl.

18. The assemblage of claim 14 wherein R represents H, Z represents O and $R^1$ represents hydroxypropyl or hydroxyethyl.

19. The assemblage of claim 13 wherein said vehicle is present at a concentration of from about 25 to about 75 percent by weight of said dye image-receiving layer.

20. The assemblage of claim 13 wherein said mordant comprises the following recurring units:

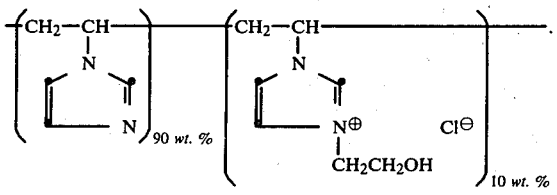

21. The assemblage of claim 13 wherein said vehicle comprises poly(2-hydroxyethyl methacrylate), poly(acrylamide-co-N-methylolacrylamide), poly(N-isopropylacrylamide-co-2-hydroxyethyl acrylate), poly(N-isopropylacrylamide-co-2-hydroxypropyl acrylate), poly(2-hydroxypropyl acrylate), poly(2-hydroxyethyl methacrylate-co-2-hydroxypropyl acrylate) or poly(N-isopropylacrylamide-co-2-hydroxyethyl methacrylate.

22. The assemblage of claim 13 wherein (a) said dye image-receiving layer is located in said photosensitive element between said support and said silver halide emulsion layer; and (b) said assemblage also includes a transparent cover sheet over the layer outermost from said support.

23. The assemblage of claim 22 wherein said transparent cover sheet is coated with, in sequence, a neutralizing layer and a timing layer.

24. The assemblage of claim 23 wherein said discharging means is a rupturable container containing said alkaline processing composition and an opacifying agent, said container being so positioned during processing of said assemblage that a compressive force applied to said container will effect a discharge of the container's contents between said transparent cover sheet and the layer outermost from said support.

25. The assemblage of claim 13 wherein said support of said photosensitive element is opaque, and said dye image-receiving layer is located on a separate transparent support superposed on the layer outermost from said opaque support.

26. The assemblage of claim 25 wherein said transparent support has thereon, in sequence, a neutralizing layer, a timing layer and said dye image-receiving layer.

27. The assemblage of claim 25 wherein said opaque support has thereon, in sequence, a neutralizing layer, a timing layer and said silver halide emulsion layer.

28. The assemblage of claim 13 wherein said dye image-providing material is a redox dye-releaser.

29. The assemblage of claim 13 wherein said photosensitive element comprises a support having thereon a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

30. In an integral photographic assemblage comprising (a) a photosensitive element comprising a transparent support having thereon the following layers in sequence: a dye image-receiving layer comprising a poly(vinylimidazole) mordant in a nonmordanting, water-permeable polymeric vehicle; an alkaline solution-permeable, light-reflective layer; an alkaline solution-permeable, opaque layer; a red-sensitive, direct-positive silver halide emulsion layer having a ballasted redox cyan dye-releaser associated therewith; a green-sensitive, direct-positive silver halide emulsion layer having a ballasted redox magenta dye-releaser associated therewith; and a blue-sensitive, direct-positive silver halide emulsion layer having a ballasted redox yellow dye-releaser associated therewith;

(b) a transparent sheet superposed over said blue-sensitive silver halide emulsion layer and comprising a transparent support coated with, in sequence, a neutralizing layer and a timing layer; and (c) a rupturable container containing an alkaline processing composition and an opacifying agent, said container being so positioned during processing of said assemblage that a compressive force applied to said container will effect a discharge of the container's contents between said transparent sheet and said blue-sensitive silver halide emulsion layer;

said assemblage containing a silver halide developing agent, the improvement wherein said vehicle comprises recurring units derived from a hydroxyalkyl acrylate ester, and/or an N-hydroxyalkylacrylamide, and/or an N-alkylacrylamide.

31. The assemblage of claim 30 wherein said vehicle comprises recurring units having the following formula:

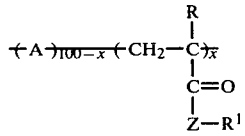

wherein:

A represents recurring units of one or more addition polymerizable monomers;

R represents H or methyl;

Z represents O or NH;

$R^1$ represents alkyl or hydroxyalkyl of 1 to about 6 carbon atoms when Z is NH, and represents hydroxyalkyl of 1 to about 6 carbon atoms when Z is O; and each x is a weight percentage integer of from about 10 to 100.

32. In a photographic element comprising a support having thereon a dye image-receiving layer comprising a poly(vinylimidazole) mordant in a nonmordanting, water-permeable polymeric vehicle, the improvement wherein said vehicle comprises recurring units derived from a hydroxyalkyl acrylate ester, and/or an N-hydroxyalkylacrylamide, and/or an N-alkylacrylamide.

33. The photographic element of claim 32 wherein said vehicle comprises recurring units having the following formula:

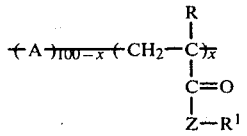

wherein:

A represents recurring units of one or more addition polymerizable monomers;

R represents H or methyl;

Z represents O or NH;

$R^1$ represents alkyl or hydroxyalkyl of 1 to about 6 carbon atoms when Z is NH, and represents hydroxyalkyl of 1 to about 6 carbon atoms when Z is O; and each x is a weight percentage integer of from about 10 to 100.

34. The photographic element of claim 33 wherein said addition polymerizable monomer is acrylamide, styrene or an alkyl acrylate, the alkyl group of which has from 1 to about 6 carbon atoms.

35. The photographic element of claim 33 wherein R represents methyl, Z represents O and $R^1$ represents hydroxyethyl.

36. The photographic element of claim 33 wherein R represents H, Z represents NH and $R^1$ represents isopropyl or hydroxymethyl.

37. The photographic element of claim 33 wherein R represents H, Z represents O and $R^1$ represents hydroxypropyl or hydroxyethyl.

38. The photographic element of claim 32 wherein said vehicle is present at a concentration of from about 25 to about 75 percent by weight of said dye image-receiving layer.

39. The photographic element of claim 32 wherein said mordant comprises the following recurring units:

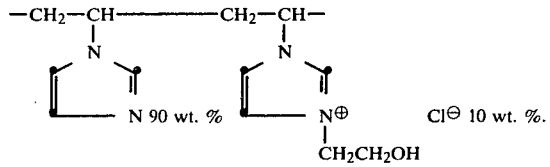

40. The photographic element of claim 32 wherein said vehicle comprises poly(2-hydroxyethyl methacrylate), poly(acrylamide-co-N-methylolacrylamide), poly(N-isopropylacrylamide-co-2-hydroxyethyl acrylate), poly(N-isopropylacrylamide-co-2-hydroxypropyl acrylate), poly(2-hydroxypropyl acrylate), poly(2-hydroxyethyl methacrylate-co-2-hydroxypropyl acrylate) or poly(N-isopropylacrylamide-co-2-hydroxyethyl methacrylate.

41. In a process for producing a photographic transfer image in color from an imagewise-exposed photosensitive element comprising a support having thereon at least one photosensitive silver halide emulsion layer having associated therewith a dye image-providing material, said process comprising treating said element with an alkaline processing composition in the presence of a silver halide developing agent to effect development of each of said exposed silver halide emulsion layers, whereby an imagewise distribution of dye image-providing material is formed as a function of development and at least a portion of it diffuses to a dye image-receiving layer to provide said transfer image, said dye image-receiving layer comprising a poly(vinylimidazole) mordant in a nonmordanting, water-permeable polymeric vehicle, the improvement wherein said vehicle comprises recurring units derived from a hydroxyalkyl acrylate ester, and/or an N-hydroxyalkylacrylamide, and/or an N-alkylacrylamide.

42. The process of claim 41 wherein said vehicle comprises recurring units having the following formula:

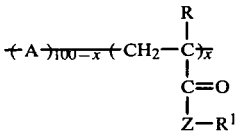

wherein:

A represents recurring units of one or more addition polymerizable monomers;

R represents H or methyl;

Z represents O or NH;

$R^1$ represents alkyl or hydroxyalkyl of 1 to about 6 carbon atoms when Z is NH, and represents hydroxyalkyl of 1 to about 6 carbon atoms when Z is O; and each x is a weight percentage integer of from about 10 to 100.

* * * * *